US009163483B2

(12) United States Patent
Ford

(10) Patent No.: US 9,163,483 B2
(45) Date of Patent: Oct. 20, 2015

(54) ROD GUIDE AND SOLIDS CONTROL ASSEMBLY

(76) Inventor: Michael Brent Ford, St. George, UT (US)

( * ) Notice: Subject to any disclaimer, the term of this patent is extended or adjusted under 35 U.S.C. 154(b) by 640 days.

(21) Appl. No.: 13/310,143

(22) Filed: Dec. 2, 2011

(65) Prior Publication Data

US 2013/0140032 A1 Jun. 6, 2013

(51) Int. Cl.
*E21B 37/00* (2006.01)
*E21B 17/10* (2006.01)

(52) U.S. Cl.
CPC ..... *E21B 37/00* (2013.01); *E21B 17/1071* (2013.01)

(58) Field of Classification Search
CPC ..... E21B 37/00; E21B 37/02
USPC ..... 166/311, 170, 176
See application file for complete search history.

(56) References Cited

U.S. PATENT DOCUMENTS

| | | | | |
|---|---|---|---|---|
| 1,342,618 | A * | 6/1920 | Bashara | 166/173 |
| 3,364,998 | A * | 1/1968 | Sable | 166/175 |
| 5,452,760 | A * | 9/1995 | Bertagnolli | 166/176 |
| 5,570,742 | A * | 11/1996 | Reynolds et al. | 166/173 |
| 7,210,529 | B2 * | 5/2007 | Ruttley | 166/311 |

OTHER PUBLICATIONS

For the American Heritage Dictionary definition: aperture. (n.d.) The American Heritage® Dictionary of the English Language, Fourth Edition. (2003). Retrieved Jun. 27, 2014 from http://www.thefreedictionary.com/aperture.*
For the American Heritage Dictionary definition: bristle. (n.d.) The American Heritage® Dictionary of the English Language, Fourth Edition. (2003). Retrieved Jul. 2, 2014 from http://www.thefreedictionary.com/bristle.*
For the American Heritage Dictionary definition: along. (n.d.) The American Heritage® Dictionary of the English Language, Fourth Edition. (2003). Retrieved Nov. 3, 2014 from http://www.thefreedictionary.com/along.*

* cited by examiner

*Primary Examiner* — Brad Harcourt
*Assistant Examiner* — Wei Wang
(74) *Attorney, Agent, or Firm* — Weiss & Moy, P.C.; Veronica-Adele R. Cao

(57) ABSTRACT

The rod guide and solids control assembly can be mounted on a rod string. The assembly can allow well fluid that contains high solids to pass through the pump under normal operation while eliminating the solids from being swept back into the pump barrel. The assembly can include a body portion coupled to a bristle that extends helically around the body portion. The body portion can be placed on a pump valve rod or hollow valve rod. On an upstroke, the bristles can be locked into place for trapping and lifting the solids. On a downstroke, the bristles can be rotated for leaving the solids higher and away from a pump intake. This can allow the solids to be lifted out of the pump and thereby prevent solids from collecting on a bottom portion of the pump. Multiple assemblies can be incorporated into the sucker rod string.

15 Claims, 8 Drawing Sheets

ROD GUIDE AND SOLIDS CONTROL ASSEMBLY

TECHNICAL FIELD

The present disclosure generally relates to fluid pumping apparatuses and more particularly, to a rod guide and solids control assembly that lifts solids within the fluid.

BACKGROUND

Oil well pumping systems are well known in the art. Such systems can be used to mechanically remove oil or other fluid from beneath the earth's surface, particularly when the natural pressure in an oil well has diminished. Generally, an oil well pumping system can begin with an above-ground pumping unit, which can be commonly referred to as a "pumpjack," "nodding donkey," "horsehead pump," "beam pump," "sucker rod pump," and the like. The pumping unit can create a reciprocating up and down pumping action that moves the oil or other substance being pumped out of the ground and into a flow line, from which the oil can then be taken to a storage tank or other such structure.

Below the ground, a shaft can be lined with piping known as "tubing." Into the tubing is inserted a string of sucker rods, which ultimately can be indirectly coupled at its north end to the above-ground pumping unit. The string of sucker rods can be indirectly coupled at its south end to a subsurface pump that is located at or near the fluid in the oil well. The subsurface pump can have a number of basic components, including a barrel and a plunger. The plunger can operate within the barrel, and the barrel, in turn, can be positioned within the tubing. It is common for the barrel to include a standing valve and the plunger to include a traveling valve. The north end of the plunger can be typically connected to a valve rod, which moves up and down to actuate the pump plunger. The valve rod can pass through a guide positioned at the north end of the barrel, which assists in centering the valve rod and thereby, the plunger. In addition, the guide can include openings through which the oil or other substance being pumped can exit the pump barrel and travel into the tubing.

There are a number of problems that can occur during oil pumping operations. Fluid that is pumped from the ground is generally impure, and includes solid impurities such as sand, pebbles, limestone, and other sediment and debris. Certain kinds of pumped fluids, such as heavy crude, tend to contain a relatively large amount of solids. Because of this, several disadvantages exist with prior valve rods. For example, after the solids have been exhausted from the pump barrel and the pump has temporarily discontinued pumping operations, the solids can naturally begin to settle due to gravity. With prior art valve rods, the solids are able to reenter the pump barrel at this time. This often results in excessive barrel wear upon restarting of the pump. Furthermore, it is possible that with the solids reentering the pump barrel, they can cause sticking of the pump i.e., seizing the plunger in the barrel.

Conventional pumps discharge fluid into the tubing allowing the fluid to move to the surface. On upstrokes, the well fluid through the pump can discharge to the top valve rod guide. When the plunger moves downward back into the barrel, the open cage atop the pump can allow fluid that was just discharged to reenter the barrel through the rod guide. The fluid discharged into the tubing from the pump can contain solids that concentrate themselves into the first two or three joints of tubing due to gravity. The fluid contained in this section of tubing can be concentrated and contain a higher percentage of solids than the fluid that was just discharged thus introducing additional solid impurities that create additional damage to both the barrel and plunger. Furthermore, the string of sucker rods reciprocating in an up and down movement can cause the rod to rub on the tubing typically made of steel. This can cause failure of the tubing resulting in leaking of fluid and thereby preventing fluid from reaching the surface.

The present disclosure relates to a rod guide and solids control assembly for use with conventional rod pumps for preventing or reducing the amount of solids from reentering back into the pump. It addresses the problems encountered in prior art pumping systems as well as provides other, related advantages.

SUMMARY

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

In accordance with one aspect of the present disclosure, a rod guide assembly is provided. The rod guide assembly can include a body portion coupled to a bristle that extends helically around the body portion.

In accordance with another aspect of the present disclosure, an apparatus for controlling solids from reentering into a pump is provided. The apparatus can include a bristle locking into place and lifting solids on an upstroke and rotating and leaving the solids behind on a downstroke.

In accordance with yet another aspect of the present disclosure, a method for removing solids from pumped fluid using an assembly is provided. The method can include locking bristles of the assembly into place for trapping and lifting the solids and rotating the bristles of the assembly for leaving the solids higher and away from a pump intake.

BRIEF DESCRIPTION OF DRAWINGS

The novel features believed to be characteristic of the disclosure are set forth in the appended claims. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The disclosure itself, however, as well as a preferred mode of use, further objectives and advantages thereof, can be best understood by reference to the following detailed description of illustrative embodiments when read in conjunction with the accompanying drawings, wherein:

DESCRIPTION OF THE DISCLOSURE

The foregoing description is provided to enable any person skilled in the relevant art to practice the various embodiments described herein. Various modifications to these embodiments can be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

Overview

Generally described, the present disclosure relates to fluid pumps and associated systems and more particularly, to a rod guide and solids control assembly that can be used with a conventional rod pump for preventing solids from reentering into the pump. In one illustrative embodiment, the rod guide and solids control assembly can be mounted on a rod string. The assembly can allow well fluid that contains high solids to pass through the pump under normal operation while eliminating the solids from being swept back into the pump barrel. The assembly can include a body portion coupled to a bristle that extends helically around the body portion. The body portion can be placed on a pump valve rod or hollow valve rod. On an upstroke, the bristles can be locked into place for trapping and lifting the solids. On a downstroke, the bristles can be rotated for leaving the solids higher and away from a pump intake. This can allow the solids to be lifted out of the pump and thereby prevent solids from collecting on a bottom portion of the pump. Multiple assemblies can be incorporated into the sucker rod string when solids are more severe.

The FIGURES provide an exemplary rod guide and solids control assembly in accordance with one aspect of the present disclosure. The rod guide and solids control assembly can be combined in numerous configurations known to those skilled in the relevant art. The assembly can be placed on a string of rod guides. The assembly can also be designed to allow well fluid that contains high solids to pass through the pump under normal operation, but eliminate the solids from being swept back into the pump barrel on the down stroke of the pump. The assembly can be referred to as a rod guide, solids control assembly or combination of both.

Assembly

Figure 1:
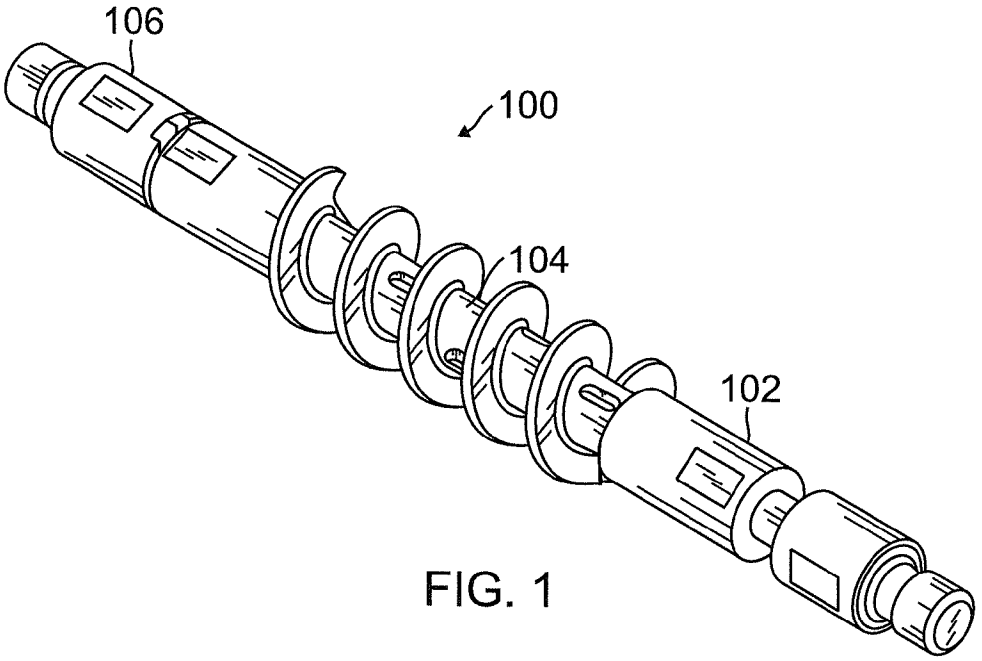
FIG. 1 is a top perspective view of an exemplary rod guide and solids control assembly in accordance with one aspect of the present disclosure.

Turning now to FIG. 1, a top perspective view of an exemplary rod guide and solids control assembly 100 in accordance with one aspect of the present disclosure is provided. Portions of the assembly 100 can be made up of a hardened material, such as carbide, an alloy or some other suitable material commonly found within such assemblies 100. The rod guide and solids control assembly 100 can include a top portion 102 and a bottom portion 106 with a body portion 104 therebetween. In this embodiment, the assembly 100 can have a substantially longitudinal shape and include a one-piece structure incorporating the top portion 102, body portion 104 and bottom portion 106.

The bottom portion 106 can have a diameter equal to the top portion 102, while the body portion 104 generally has a diameter that is smaller than both. The body portion 104 can have a bristle. The diameter of the body portion 104 along with the bristle can be greater than a diameter of the top portion 102 and bottom portion 106.

The bottom portion 106 can include male threading such that it can be coupled to a rod string. This configuration permits the bottom portion 106 of the assembly 100 to be fastened directly into the rod string without the need for any connector components. While the bottom portion 106 can be a male component in this embodiment of the assembly 100, it should be clearly understood that substantial benefit could be derived from an alternate configuration of the bottom portion 106 in which a female threaded component is employed, without departing from the spirit or scope of the present disclosure.

Furthermore, the top portion 102 can include male threading such that it can be coupled to a rod string. This configuration permits the top portion 102 of the assembly 100 to be fastened directly into the rod string without the need for any connector components. While the top portion 102 can be a male component in this embodiment of the assembly 100, it should be clearly understood that substantial benefit could be derived from an alternate configuration of the top portion 102 in which a female threaded component is employed, without departing from the spirit or scope of the present disclosure.

Figure 2:
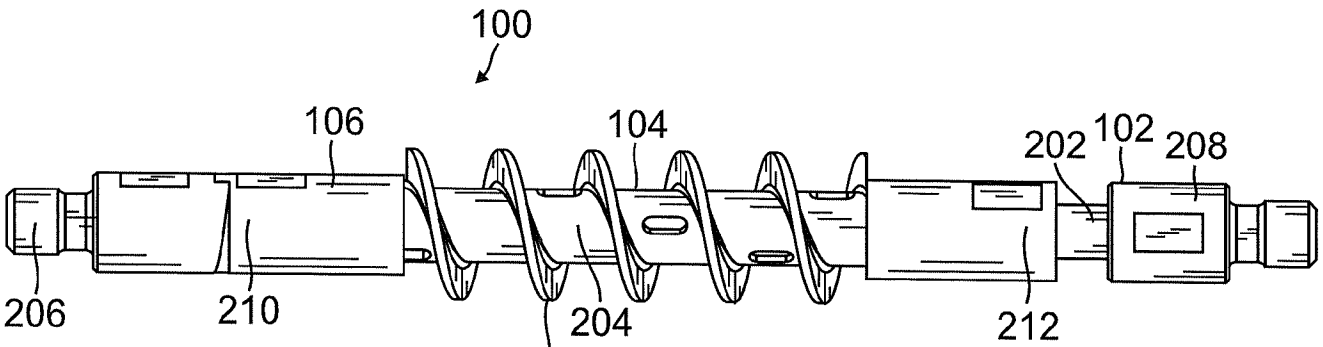
FIG. 2 is a side view of the exemplary rod guide and solids control assembly of FIG. 1.

Referring now to FIG. 2, a side view of the exemplary rod guide and solids control assembly 100 of FIG. 1 is provided. The assembly 100 can include a rod 202, brush tube 204, end cap with clutch 206, end cap 208, brush retainer with clutch 210, brush retainer 212 and bristle 214. The end cap 208 and brush retainer 212 can be located on the top portion 102 of the rod guide and solids control assembly 100. The end cap with clutch 206 and the brush retainer with clutch 210 can be placed on a bottom portion 106 of the assembly 100. Those skilled in the relevant art will appreciate that various combinations of these elements, as well as fewer or additional components, can be added to the assembly 100.

Figure 3:
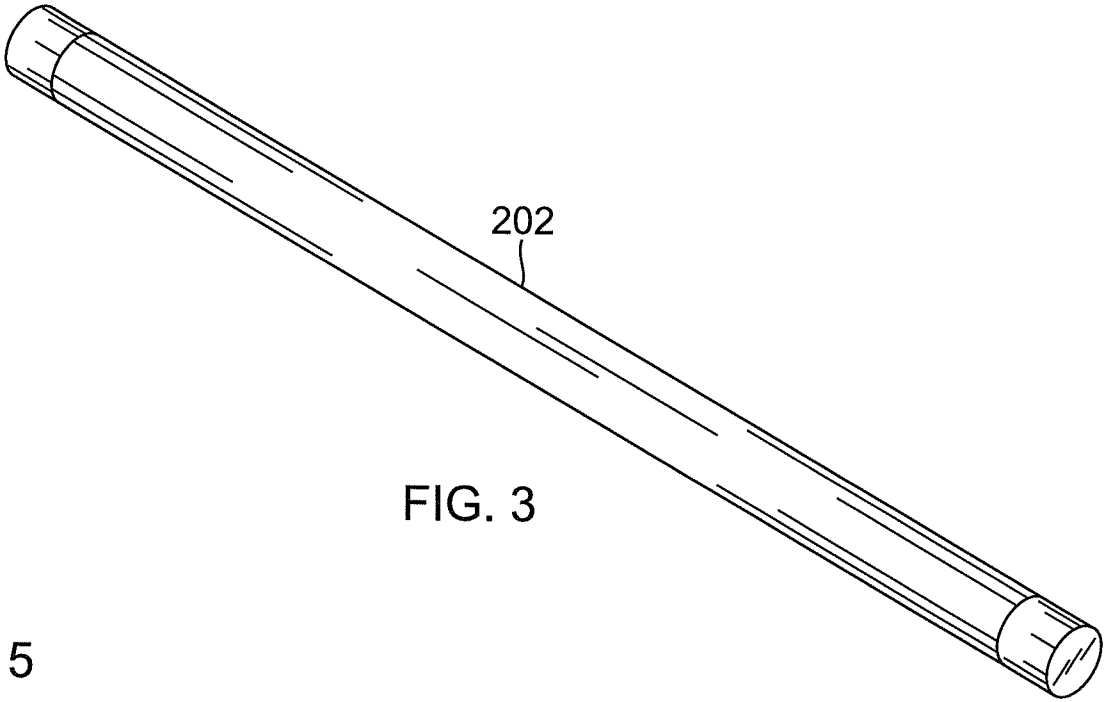
FIG. 3 is a top perspective view of an illustrative rod of the exemplary rod guide and solids control assembly of FIG. 1.
Figure 5:
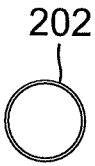
FIG. 5 is a top view of the illustrative rod of FIG. 3.
Figure 4:
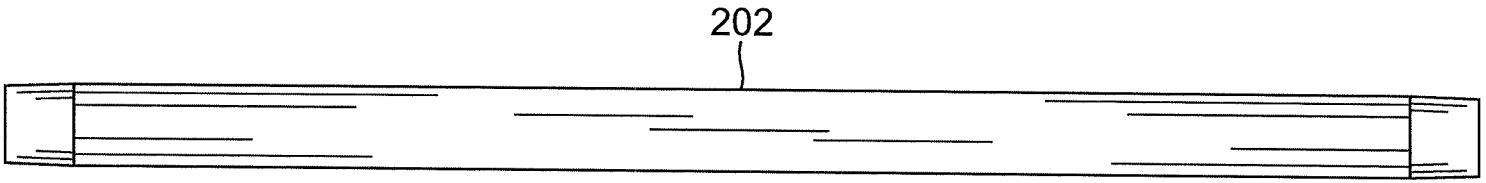
FIG. 4 is a side view of the illustrative rod of FIG. 3.

A rod 202 within the assembly 100 can extend through the bottom portion 106, body portion 104 and top portion 102. Turning to FIG. 3, a top perspective view of an illustrative rod 202 of the exemplary rod guide and solids control assembly 100 of FIG. 1 is provided. The rod 202 can have a long cylindrical shape and generally, a diameter less than the bottom portion 106, body portion 104 and top portion 102. Fastening mechanisms can be provided by the rod 202 or other component within the assembly 100 that can securely fasten the rod 202 in place. The rod 202 can be hollow or have a channel therein. Generally, the rod 202 can have a uniform diameter and take on a cylindrical shape. FIG. 4 is a side view of the illustrative rod 202 of FIG. 3, while FIG. 5 is a top view of the illustrative rod 202 of FIG. 3.

Figure 6:
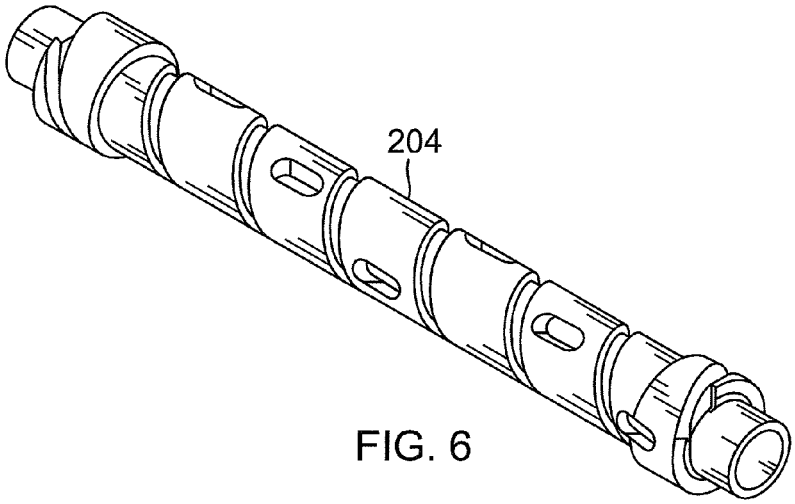
FIG. 6 is a top perspective view of an illustrative brush tube of the exemplary rod guide and solids control assembly of FIG. 1 in accordance with one aspect of the present disclosure.
Figure 7:
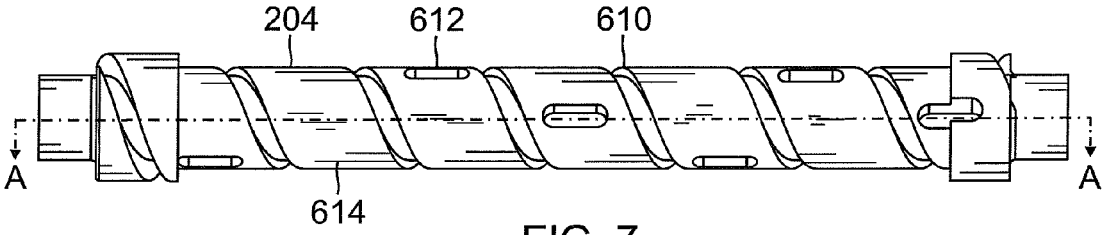
FIG. 7 is a side view of the illustrative brush tube of FIG. 6.

Referring now to FIG. 6, a top perspective view of an illustrative brush tube 204 of the exemplary rod guide and solids control assembly 100 of FIG. 1 in accordance with one aspect of the present disclosure is provided. The brush tube 204 can be cylindrical with a channel running therethrough for the rod 202. FIG. 7 is a side view of the illustrative brush tube 204 of FIG. 6. A helical groove 610 can be formed on the brush tube 204. The helical groove 610 can spiral around the brush tube 204 at various angles, for example, thirty degrees. The groove 610 can spiral along the length of the brush tube 204. These spirals can create sections between the grooves 610.

Figure 8:
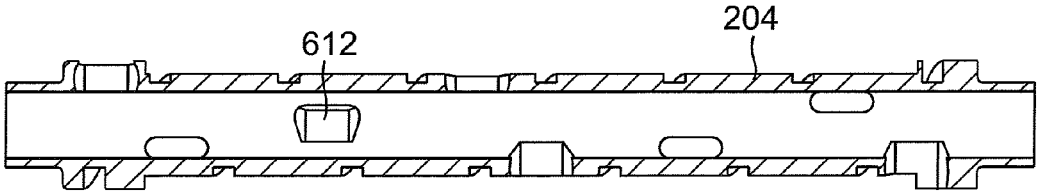
FIG. 8 is a cross-sectional view of the illustrative brush tube of FIG. 7 along line A-A.
Figure 9:
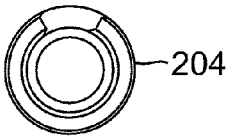
FIG. 9 is a top view of illustrative brush tube of FIG. 6.

Each section of the brush tube 204 can have an aperture 612. The apertures 612 can lead into the channel of the brush tube 602. The apertures 612 within each of the sections can also spiral downwards. Other patterns for the apertures 612 can be incorporated within the brush tube 204 known to those skilled in the relevant art. FIG. 8 is a cross-sectional view of the illustrative brush tube 204 of FIG. 7 along line A-A. The internal channel can be hollow with apertures 612 extending to the outside of the brush tube 204. FIG. 9 is a top view of illustrative brush tube 204 of FIG. 6.

Figure 10:
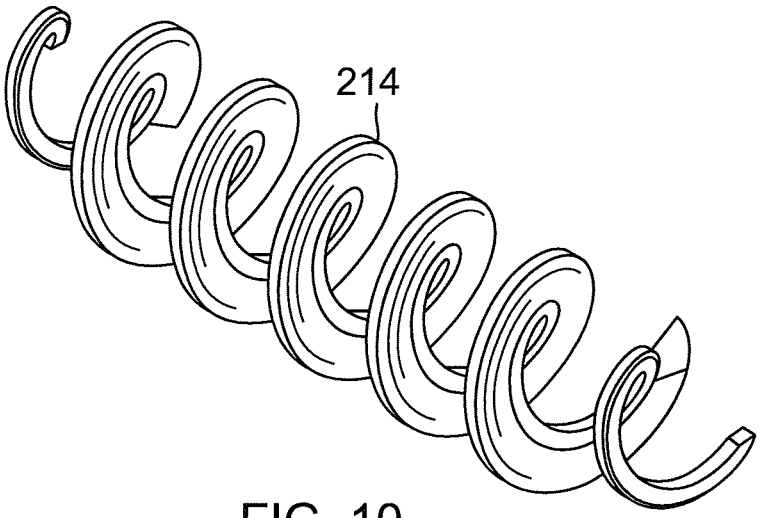
FIG. 10 is a top perspective view of an illustrative bristle of the exemplary rod guide and solids control assembly of FIG. 1 in accordance with one aspect of the present disclosure.
Figure 11:
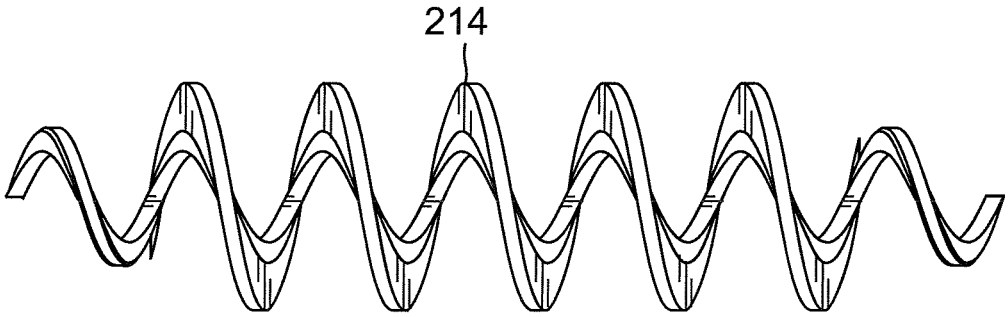
FIG. 11 is a side view of the illustrative bristle of FIG. 10.
Figure 12:
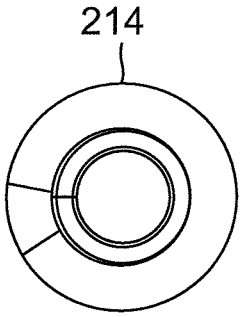
FIG. 12 is a top view of the illustrative bristle of FIG. 10.

Referring to FIG. 10, a top perspective view of an illustrative bristle 214 of the exemplary rod guide and solids control assembly 100 of FIG. 1 in accordance with one aspect of the present disclosure is provided. The bristle 214 can have a spiral shape and conform to the groove 610 of the brush tube 204. FIG. 11 is a side view of the illustrative bristle 214 of FIG. 10, while FIG. 12 is a top view of illustrative bristle 214 of FIG. 10.

The bristle 214, in one embodiment, can be helical and spiral around the groove 610 of the assembly 100. The bristle 214 can be configured at different angles, for example, at thirty degrees. The bristle 214 can be made of a wide variety of materials. These materials can include, but are not limited to, steel, plastic, polymer, etc. and can depend on conditions of the pump. The bristle 214 can extend between the bottom portion 106 and the top portion 102. The bristles 214 can generally be spaced equidistant from each other.

Figure 13:
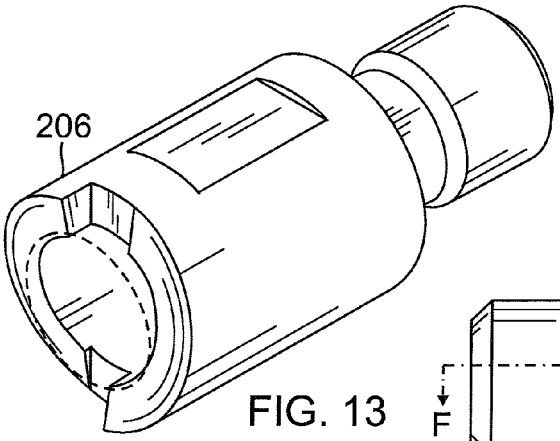
FIG. 13 is a top perspective view of an illustrative end cap with clutch of the exemplary rod guide and solids control assembly of FIG. 1 in accordance with one aspect of the present disclosure.
Figure 14:
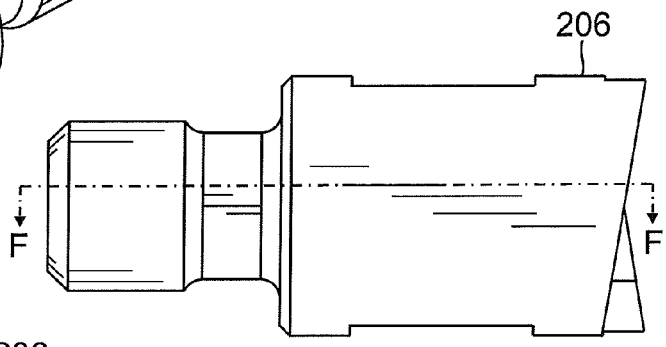
FIG. 14 is a side view of the illustrative end cap with clutch of FIG. 13.

Turning to FIG. 13, a top perspective view of an illustrative end cap with clutch 206 of the exemplary rod guide and solids control assembly 100 of FIG. 1 in accordance with one aspect of the present disclosure is provided. The end cap with clutch 206 can work in tandem with the brush retainer with clutch 210. The end cap with clutch 206 can tightly secure the components of the assembly 100. FIG. 14 is a side view of the illustrative end cap with clutch 206 of FIG. 13.

Figure 15:
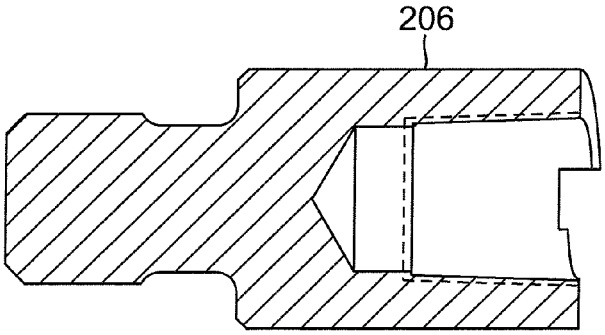
FIG. 15 is a cross-sectional view of the illustrative end cap with clutch of FIG. 14 along line F-F.
Figure 16:
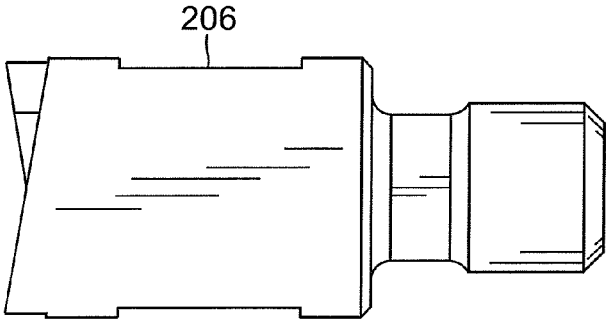
FIG. 16 is a side view of the illustrative end cap with clutch of FIG. 13.
Figure 17:
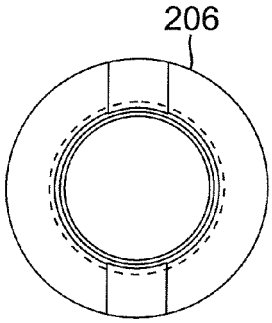
FIG. 17 is a top view of illustrative end cap with clutch of FIG. 13.

FIG. 15 is a cross-sectional view of the illustrative end cap with clutch 206 of FIG. 14 along line F-F. As shown, the end cap with clutch 206 can include an inlet where the rod 202 can be fitted. FIG. 16 is a side view of the illustrative end cap with clutch 206 of FIG. 13. FIG. 17 is a top view of illustrative end cap with clutch 206 of FIG. 13.

Figure 18:
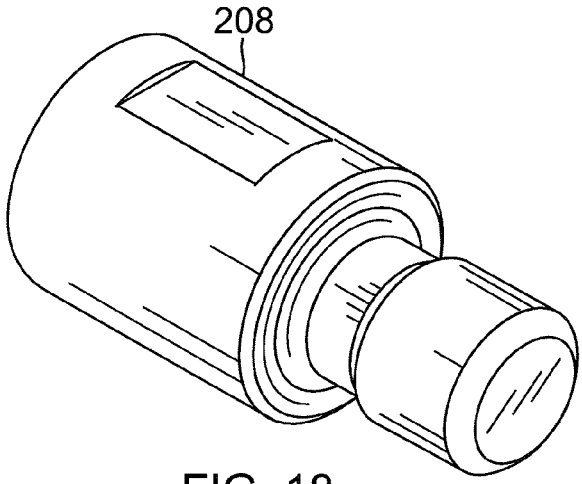
FIG. 18 is a top perspective view of an illustrative end cap of the exemplary rod guide and solids control assembly of FIG. 1 in accordance with one aspect of the present disclosure.
Figure 19:
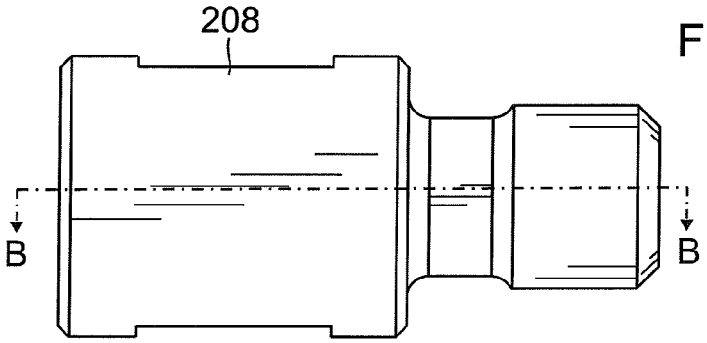
FIG. 19 is a side view of the illustrative end cap of FIG. 18.
Figure 20:
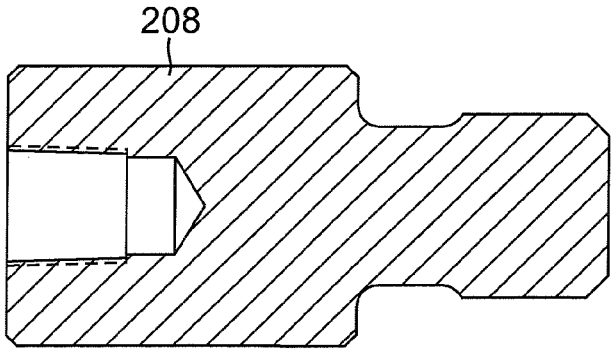
FIG. 20 is a cross-sectional view of the illustrative end cap of FIG. 19 along line B-B.
Figure 21:
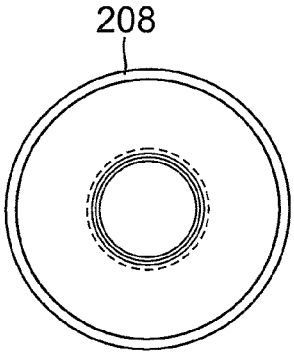
FIG. 21 is a top view of illustrative end cap of FIG. 18.

On the other end of the rod guide and solids control assembly 100, an end cap 208 is provided as shown in FIG. 18, which is a top perspective view of an illustrative end cap 208 of the exemplary rod guide and solids control assembly 100 of FIG. 1 in accordance with one aspect of the present disclosure. The end cap 208 can work in tandem with the brush retainer 212. The end cap 208 can tightly secure the components of the assembly 100. The end cap 208 can be coupled to the brush retainer 212 or be separated therefrom. FIG. 19 is a side view of the illustrative end cap 208 of FIG. 18. FIG. 20 is a cross-sectional view of the illustrative end cap 208 of FIG. 19 along line B-B. The end cap 208 can include an inlet that can be fitted to the rod 202. FIG. 21 is a top view of illustrative end cap 208 of FIG. 18.

Figure 22:
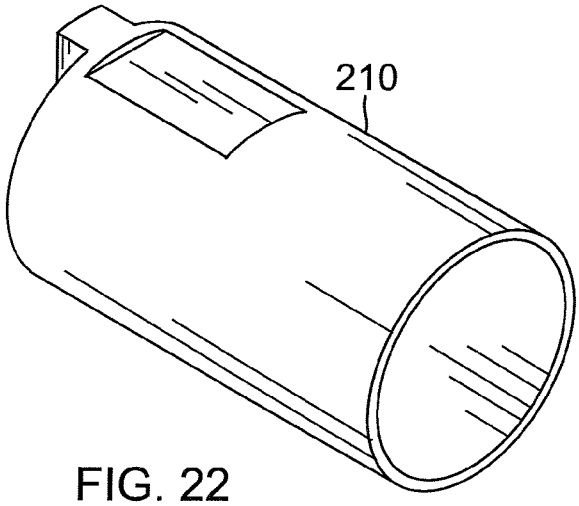
FIG. 22 is a top perspective view of an illustrative brush retainer with clutch of the exemplary rod guide and solids control assembly of FIG. 1 in accordance with one aspect of the present disclosure.
Figure 23:
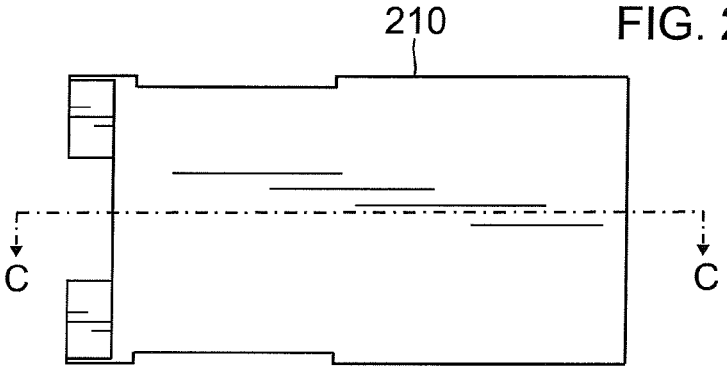
FIG. 23 is a side view of the illustrative brush retainer with clutch of FIG. 22.
Figure 24:
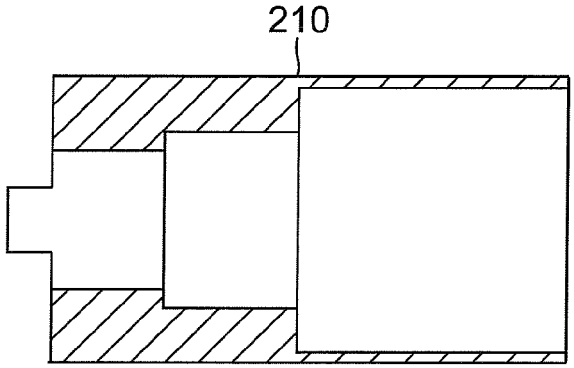
FIG. 24 is a cross-sectional view of the illustrative brush retainer with clutch of FIG. 23 along line C-C.
Figure 25:
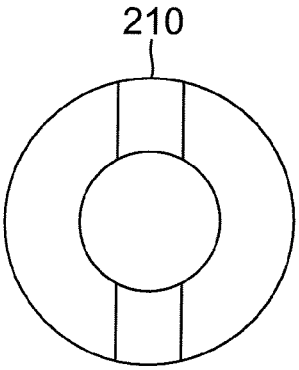
FIG. 25 is a top view of illustrative brush retainer with clutch of FIG. 22.

Referring to FIG. 22, a top perspective view of an illustrative brush retainer with clutch 210 of the exemplary rod guide and solids control assembly 100 of FIG. 1 in accordance with one aspect of the present disclosure is provided. The brush retainer with clutch 210 can include an inlet for receiving the rod 202. FIG. 23 is a side view of the illustrative brush retainer with clutch 210 of FIG. 22. FIG. 24 is a cross-sectional view of the illustrative brush retainer with clutch 210 of FIG. 23 along line C-C. FIG. 25 is a top view of illustrative brush retainer with clutch 210 of FIG. 22.

Figure 26:
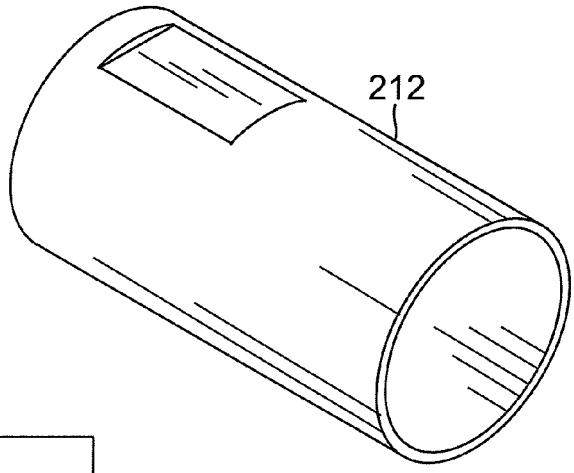
FIG. 26 is a top perspective view of an illustrative brush retainer of the exemplary rod guide and solids control assembly of FIG. 1 in accordance with one aspect of the present disclosure.
Figure 27:
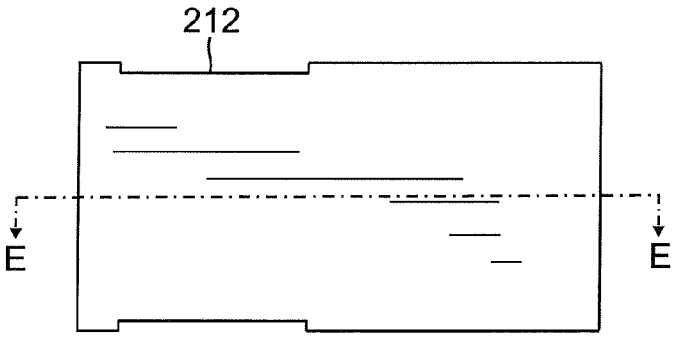
FIG. 27 is a side view of the illustrative brush retainer of FIG. 26.
Figure 28:
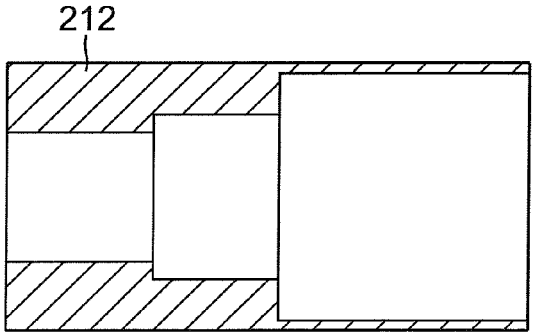
FIG. 28 is a cross-sectional view of the illustrative brush retainer of FIG. 27 along line E-E.
Figure 29:
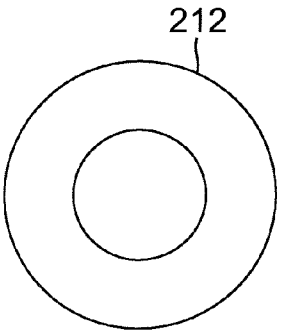
FIG. 29 is a top view of illustrative brush retainer of FIG. 26.

Turning to FIG. 26, a top perspective view of an illustrative brush retainer 212 of the exemplary rod guide and solids control assembly 100 of FIG. 1 in accordance with one aspect of the present disclosure is provided. The brush retainer 212 can include an inlet for receiving the rod 202. FIG. 27 is a side view of the illustrative brush retainer 212 of FIG. 26. FIG. 28 is a cross-sectional view of the illustrative brush retainer 212 of FIG. 27 along line E-E and FIG. 29 is a top view of illustrative brush retainer 212 of FIG. 26.

Operation

In operation, a pumping unit can create a reciprocating up and down pumping action on the rod guide and solids control assembly 100. This action can move the oil or other substance being pumped out of the ground and into a flow line, from which the oil can then be taken to a storage tank or other such structure. The assembly 100 can be placed within tubing defining a shaft of the pump. The assembly 100 can be coupled to a rod string. In one embodiment, the assembly 100 can be a rod guide and placed away from the pump in an upper first joint of the rod just up from the pump inside the tubing.

Through the pumping unit, the assembly 100 reciprocates in an up and down movement. The bristles 214 coupled to the brush tube 204 of the body portion 104 can prevent the rod from rubbing against the steel tubing. In essence, the bristles 214 can act as a rod guide. While one assembly 100 can be used, those skilled in the relevant art will appreciate that more than one assembly 100 can also be provided within the pumping unit.

On an upstroke of the rod guide and solids control assembly 100, the helical bristle 214 can lock in place. In one embodiment, the bristle 214 along with the brush tube 204 can be held in place. By locking the bristle 214, solids can be lifted that are in the fluid. The bristles 214 can trap the solids lifting them away from the pump.

On a downstroke of the assembly 100, the bristle 214 can unlock and rotate allowing it to cork screw itself through the volume of fluid. The bristle 214 along with the brush tube 204 can rotate on the downstroke. This action can leave the solids that it had collected behind high in the tubing away from the pump intake. When the pump plunger lowers back into the pump, there can be fluid back flow. The well fluid solids can concentrate just outside the pump intake and gradually become less concentrated further up the tubing.

The helical cork screw action of the free-wheeling motion of the bristle 214 generally does not allow rod stacking since there is no resistance to the bristle 214 or interference in the turning. When the bristle 214 is fixed on the downstroke of the rods, the rods can force the bristle 214 through the fluid causing great resistance. This action can stack the rods causing the rods to be forced in the tubing wall causing damage to both the rod and the tubing.

Systems, Apparatus and Methods

In accordance with one aspect of the present disclosure, a rod guide assembly is provided. The rod guide assembly can include a body portion coupled to a bristle that extends helically around the body portion.

In one embodiment, the bristle can rotate on a downstroke of the rod guide assembly. In one embodiment, the bristle can lock into place on an upstroke of the rod guide assembly. In one embodiment, the rod guide assembly can include a top portion that can have a brush retainer and end cap and a bottom portion that can have a brush retainer with clutch and end cap with clutch. In one embodiment, the body portion can include a brush tube having a helical groove for placement of the bristle. In one embodiment, the groove can spiral at a thirty degree angle. In one embodiment, apertures can be provided between the spirals.

In accordance with another aspect of the present disclosure, an apparatus for controlling solids from reentering into a pump is provided. The apparatus can include a bristle locking into place and lifting solids on an upstroke and rotating and leaving the solids behind on a downstroke.

In one embodiment, the bristle can be helical and extend around a body portion of the apparatus. In one embodiment, the apparatus can include a rod string that causes the upstroke and downstroke. In one embodiment, the apparatus can include a top portion and bottom portion. In one embodiment, the apparatus can include a brush retainer and end cap coupled to the top portion and a brush retainer with clutch and end cap with clutch coupled to the bottom portion.

In accordance with yet another aspect of the present disclosure, a method for removing solids from pumped fluid using an assembly is provided. The method can include locking bristles of the assembly into place for trapping and lifting the solids and rotating the bristles of the assembly for leaving the solids higher and away from a pump intake.

In one embodiment, locking the bristles can occur on an upstroke of the assembly and rotating the bristles can occur on a downstroke of the assembly. In one embodiment, the method can include multiple upstrokes and downstrokes for removing the solids. In one embodiment, the multiple upstrokes and downstrokes can cause concentration of the solids away from a pump intake.

In one embodiment, wherein rotating the bristles can include generating a corkscrew action with the bristles. In one embodiment, the corkscrew action can cause fluid back flow. In one embodiment, the method can include attaching the assembly to a rod string. In one embodiment, the method can include placing the assembly in a first joint of the rod string.

The foregoing description is provided to enable any person skilled in the relevant art to practice the various embodiments described herein. Various modifications to these embodiments can be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. A rod guide assembly comprising:

a top portion;

a bottom portion;

a body portion positioned between said top portion and said bottom portion, said body portion having:

a helical groove formed on said body portion and spiraling vertically along a length of said body portion; and a bristle coupled to said body portion and positioned within said groove, wherein said bristle extends continuously and helically within said groove of said body portion so that said bristle conforms to a spiral shape of said groove, wherein said bristle is adapted to lock into place from an initiation of an upstroke of said rod guide assembly to an end of said upstroke in order to lift and trap solids away from pumped fluid, and wherein said bristle is adapted to generate a corkscrew action through said pumped fluid during a downstroke of said rod guide assembly.

2. The rod guide assembly of claim 1, wherein said bristle rotates on a downstroke of said rod guide assembly.

3. The rod guide assembly of claim 1, comprising a top portion that includes a brush retainer and end cap and a bottom portion that includes a brush retainer with clutch and end cap with clutch.

4. The rod guide assembly of claim 1, wherein said body portion is placed on a pump valve rod or hollow valve rod.

5. The rod guide assembly of claim 1, comprising apertures formed on said body portion and positioned between spirals formed by said groove, wherein said apertures lead into a channel running through the body portion.

6. A method for removing solids from pumped fluid using an assembly comprising the steps of:

providing a rod guide assembly comprising:

a top portion;

a bottom portion;

a body portion positioned between said top portion and said bottom portion, said body portion having:

a helical groove formed on said body portion and spiraling vertically along a length of said body portion; and a bristle coupled to said body portion and positioned within said groove, wherein said bristle extends continuously and helically within said groove of said body portion so that said bristle conforms to a spiral shape of said groove;

locking said bristle of said assembly into place from an initiation of an upstroke of said rod guide assembly to and end of said upstroke for trapping and lifting said solids away from said pumped fluid; and unlocking and rotating said bristle of said assembly during a downstroke of said rod guide assembly for generating a corkscrew action through said pumped fluid and for leaving said solids higher and away from said pumped fluid.

7. The method of claim 6, comprising multiple upstrokes and downstrokes for removing said solids.

8. The method of claim 6, wherein said multiple upstrokes and downstrokes causes concentration of said solids away from the pumped fluid.

9. The method of claim 6, wherein said corkscrew action causes fluid back flow.

10. The method of claim 6, comprising attaching said rod guide assembly to a rod string.

11. The method of claim 10, comprising placing said rod guide assembly in a first joint of said rod string.

12. A rod guide assembly for solids control comprising:

a rod;

a brush tube having a helical groove formed on said brush tube and spiraling vertically along a length of the brush tube and having a channel formed therethrough for receiving said rod;

a helical bristle coupled to said brush tube and positioned within said groove, wherein said bristle extends continuously and helically within said groove so that said bristle conforms to a spiral shape of said groove;

a first brush retainer positioned proximate a top portion of said helical bristle and having a channel formed therethrough for receiving said rod;

a first end cap positioned proximate a top portion of said first brush retainer and having an inlet formed therein for receiving a top end of said rod;

a second brush retainer positioned proximate a bottom portion of said helical bristle and having a channel formed therethrough for receiving said rod; and a second end cap positioned proximate a bottom portion of said second brush retainer and having an inlet formed therein for receiving a bottom end of said rod, wherein said brush tube, said bristle, said first brush retainer, and said second brush retainer, rotate about said rod during a downstroke of said rod guide assembly in order to generate a corkscrew action through pumped fluid and wherein said bristle rotates until said bristle locks into place from an initiation of an upstroke of said rod guide assembly to an end of said upstroke in order to trap and lift solids away from said pumped fluid.

13. The rod guide assembly of claim 12 further comprising:

a clutch formed on a bottom end of said second brush retainer; and a clutch formed on a top end of said second end cap;

wherein said clutch of said second brush retainer and said clutch of said second end cap are adapted to engage each other in order to cause said bristle to lock into place during an upstroke of said rod guide assembly.

14. The rod guide assembly of claim 12 further comprising a plurality of apertures formed along said length of said brush tube, wherein said apertures lead into a channel running through said brush tube and are located within sections of said brush tube defined by spirals formed by said groove.

15. The rod guide assembly of claim 14 wherein the apertures form a spiral configuration along said length of said brush tube.

* * * * *